US010378225B1

(12) United States Patent
Bennett

(10) Patent No.: US 10,378,225 B1
(45) Date of Patent: Aug. 13, 2019

(54) ARTIFICIAL SURFING REEF FOR AFFECTING SURFACE WAVES

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 14 days.

(21) Appl. No.: 16/119,034

(22) Filed: Aug. 31, 2018

(51) Int. Cl.
*A63G 31/00* (2006.01)
*E04H 4/00* (2006.01)
*A63B 69/00* (2006.01)

(52) U.S. Cl.
CPC ..... *E04H 4/0006* (2013.01); *A63G 31/007* (2013.01); *A63B 69/0093* (2013.01)

(58) Field of Classification Search
CPC ..... A63G 31/007; A63B 69/0093; A47K 3/10
USPC ..... 405/79; 472/128; 4/491
See application file for complete search history.

(56) References Cited

U.S. PATENT DOCUMENTS 3,956,779 A * 5/1976 Jewett ..... A63B 5/10 4/504
5,207,531 A 5/1993 Ross
7,144,197 B2 12/2006 Black
7,497,643 B2 3/2009 Carnahan et al.
2001/0014256 A1 4/2001 Carnahan et al.
2003/0077122 A1 4/2003 Carnahan et al.
2003/0119592 A1 6/2003 Lochtefeld
2009/0297270 A1 12/2009 Mead
2010/0017951 A1 1/2010 Odriozola Sagastume
2015/0089731 A1 4/2015 Lochtefeld
2017/0204627 A1 7/2017 Trevis

* cited by examiner

*Primary Examiner* — Sunil Singh

(57) ABSTRACT

The present invention is an artificial surfing reef for modifying a body of water's bathymetry to create surfing waves. The artificial surfing reef is a shaped structure made up of many sized and shaped Expanded Polystyrene Geo Foam blocks. As swell moves toward the shore, its bottom is resisted by the leading edge of the Expanded Polystyrene Geo Foam artificial surfing reef. As the swell transverses over the Expanded Polystyrene Geo Foam Artificial reef, the wave topples over and forms a plunging surfing wave. An earth anchor, connected to a cable, linked to a round shaped anchor disc, is attached to each Expanded Polystyrene Geo Foam block for maintaining the foam artificial reef at a desired location submersed underwater. A plurality of Expanded Polystyrene Geo Foam blocks may be attached to one another and configured so as to define a surf reef, which enhances the suitability of waves for surfing.

5 Claims, 5 Drawing Sheets

ARTIFICIAL SURFING REEF FOR AFFECTING SURFACE WAVES

PRIORITY

This patent claims priority from U.S. provisional application No. 62/719,164 filed on Aug. 17, 2018.

FIELD OF THE INVENTION

The present invention relates generally to an artificial surfing reef which may be configured so as to facilitate the enhancement of waves such that the waves are better suited for bodysurfing, long board surfing, short board surfing, body boarding and other recreational water activities, and which may also be configured to reduce wave height.

BACKGROUND OF THE INVENTION

Surf pools are very large bodies of water for the sport of surfing. These surf pools can be as large as 2-4 acres in size. Construction of one of these surf pools is very expensive. The typical method for building a surf lake is to use rebar and concrete to construct the surf pool. The cement bottom on a slight slope is currently used to break waves in surf pools. Reefs can also be shaped by using dirt and is shaped by hand or most commonly, by heavy machinery. Moving dirt is very timely; the dirt has to be trucked in and out of the surf pool to be able to shape the reefs to the correct bathymetry. This dirt moving and shaping can also be hard on the body and injuries can occur from heavy back-breaking work. To move, redistribute the dirt and to shape the bottom bathymetry with dirt can take months. The present invention improves ways to construct surfing reefs in surfing pools by being less expensive, saving time, for less cost and prevents injuries to worker. The present invention uses Expanded Polystyrene Geo Foam Blocks to construct the bathymetry (bottom) of the surf lake. The Geo Foam blocks are easy to shape, cut and mold and are very lightweight. Using the Expanded Polystyrene Geo Foam blocks can take only a short time period to install and works very much like putting pieces of a puzzle together, as all the blocks are individually numbered.

DESCRIPTION OF THE RELATED ART

It is well-known that natural reefs tend to enhance waves so as to make them more suitable for recreational activities such as bodysurfing, board surfing, boogie boarding and the like. Such natural reefs cause waves to break in a manner which is desirable for such activities. Such breaking occurs as the water depth is decreased by the reef, according to well-known principles.

At least one artificial reef for enhancing waves so as to make them more suitable for surfing is known. U.S. Pat. No. 5,207,531, issued to Ross on May 4, 1993, which discloses an artificial surfing reef for modifying an ocean floor near the shore so as to create surfing waves.

Although the Ross artificial surfing reef may be effective in enhancing waves so as to make them more suitable for surfing, it is important to note that the Ross artificial surfing reef suffers from inherent disadvantages which detract from its overall effectiveness and desirability. For example, the Ross artificial surfing reef is comprised of a plurality of polyvinyl chloride (PVC) pipes configured in a V-shape or Y-shape. Although the use of PVC pipes does facilitate the construction of an artificial reef which is substantially lighter than a similar reef comprised of concrete or rock, an artificial reef constructed of PVC pipe is still undesirably heavy, bulky and difficult to transport, both upon the land and while in the water.

Artificial reefs comprised of materials such as concrete, stone or PVC present a substantial safety hazard to surfers who are subject to being tossed forcefully upon such structures. This may occur, for example, when a surfer "wipes out".

In view of the foregoing, it is desirable to provide an artificial reef which is light in weight, and which is substantially resilient so as to provide an artificial reef which is comparatively safe for use in surfing and other recreational water activities.

In U.S. Pat. No. 7,497,643, US20030077122, US20010014256A1, US20030077122A1, Richard Carnahan, Troy Knight, Garrett Johnson, an artificial reef comprising at least one bag which is generally configured to define at least a portion of the artificial reef and which is at least partially fillable with air. As used herein, the term "reef" is defined to include a structure which is disposed substantially underwater and which is capable of substantially modifying a wave. Thus, according to Carnahan, Knight, Johnson, the artificial reef is defined by filling one or more bags at least partially with air. This makes the air-filled reefs to be buoyant. The use of air filled bags has substantial advantages over prior art rigid structures. The use of air for filling the bags is convenient in that air is readily available and easily pumped. Further, air can be provided from compressed air bottles, thereby eliminating any need to use a pump. Unlike the current invention, which is made of Expanded Polystyrene Geo Foam blocks, in Carnahan, Knight, Johnson, the air bags are made of vinyl lining. The air bags are very time consuming to make, require a lot of steps in constructing them and require a lot of hardware to attach them to each other.

An example of a purpose-built artificial reef for improving hydrodynamics for surfing is disclosed in the published international patent application whose international publication number is U.S. Pat. No. 7,144,197, Surf Pools Limited & Mead, Black. The artificial reef is in the form of a variable floor for a body of water. The variable floor includes a base portion for location on or within a fixed floor of the body of water, and means to adjust the slope of the upper surface of the variable floor relative to the fixed floor or base portion in one or both of a first direction transverse to the direction of travel of waves and in a second direction transverse to the first direction.

The artificial reef disclosed in the aforementioned patent application suffers from a number of deficiencies, including that it is extremely complex and expensive to construct, and that it requires a significant amount of energy to operate.

In Coblyn, WO2009132378 A1 patent, an artificial reef for affecting surface waves propagating along a surface of a body of water comprises an inclined upper surface including a plurality of baffles. The reef is submergible in a body of water such that the waves are able to propagate over the reef, and such that the upper surface faces towards the waves as the waves propagate towards the reef. The artificial reef in Coblyn is a detachable reef and contains PVC baffles along the top portion of the reef.

In US20170204627A1, and WO2015188219A1, Trevis, the claims teach of a reef module structure in a body of water. The reefs are not made of geo foam blocks as in the current invention. In Trevis the claims state that the reef modules are simple "positioned" on the bottom of the pool. The invention fails to show how the modules are secured to the bottom of the body of water and also fails to state the type of material that the reef modules are made of. In contrast in the current invention, the individual geo foam blocks are secured to the bottom of the surf lake by using an anchor, anchor cable and a round plastic disc, that is pulled tight to secure the reef structures to the bottom of the surf lake. In Trevis, the reef module comprises at least one support leg and a body mounted for rotation on the at least one support leg. Wherein the at least one support leg is telescopic. The telescopic feature of this invention is to adjust the height of the reef. In the current invention, the artificial reef the Geo Foam blocks are cut, shaped and contoured to form various slope gradient heights and peel angels. In Trevis fails to state the artificial reefs are broken up into different sections within the reefs, where different maneuvers can be done on each section based on experience level, as so claimed in the current invention.

In US Patent 20100017951A, Sagastume, shows a moving reef wave generating device. The device includes a triangle shaped reef for affecting surface waves along a surface of a body of water. The reef profile is pulled along a track or a cable under water such that the waves are able to propagate over the movable reef structure. Unlike as in the current invention, Sagastume is not made of Geo Foam blocks and is not fixed stationary to the bottom of the body of water as in the current invention.

In US Patent US20090297270A1, Mead and Black, A method of constructing an artificial reef. The method includes attaching a reef element to a support structure. The support structure and the attached reef element are then transported to a location on the surface of a body of water above an installation location on the seabed. The support structure is secured to the seabed using a coupling means while the support structure and the reef element are at the surface location. The support structure and the reef element are then moved from the surface to the installation location on the seabed using the coupling means.

In US Patent, US20030119592A1, Lochtefeld, the invention relates to a wave generating system comprising a wave generator that travels along the surface of a body of water, and preferably in the middle thereof, wherein the wave generator can create both primary and secondary waves that travel toward the shore. The artificial reef is pulled along on a track or a cable to propagate the waves. The primary waves are intended to allow surfing maneuvers to be performed in a relatively deep-water environment. In the preferred embodiment, the body of water has opposing undulating shorelines upon which the secondary waves can break, wherein by modifying the shoreline's slope and curvature, and providing undulating peninsulas and cove areas, various multiple wave formations and effects can be created. The reef profile is pulled along a track or a cable under water such that the waves are able to propagate over the movable reef structure. Unlike as in the current invention, Lochtefeld, is not made of Geo Foam blocks and is not fixed stationary to the bottom of the body of water as in the current invention.

The above prior art teaches away from the current invention. The above prior art are all artificial reef patents that are man-made, with various materials and are placed in a body of water by different means to produce waves in very different ways. There is other prior art that shows artificial reefs in bodies of water for surfing but they are created by the dirt on the bottom of the body of water vs. being a man-made module, profile, or individual created modules formed together to create an artificial reef that propagates waves for surfing.

SUMMARY OF THE INVENTION

An advantage of the current invention is use of Expanded Polystyrene Geo Foam for the artificial reef is that a comparatively soft and resilient surface is provided. A soft foam surface is particularly desirable when the artificial reef of the present invention is used in recreational applications, wherein users are likely to inadvertently strike the artificial reef. For example, when used in a surf pool, surfers may "wipeout" and be thrown forcefully against the artificial reef. Of course, the softer and more flexible the artificial reef, the less likely that such a person is to sustain an injury when inadvertently coming in contact with the artificial reef.

The Expanded Polystyrene Geo Foam blocks are very light; one hundred times lighter than dirt in comparison. The Expanded Polystyrene Geo Foam blocks are excellent for construction, because they are light and easy to work with. Each Expanded Polystyrene Geo Foam block can easily be lifted up by hand and set into place. The Expanded Polystyrene Geo Foam also speeds up construction time, because the blocks can be strategically placed in the surf pool to form the desired reef shape. The Expanded Polystyrene Geo Foam blocks are advantageous because they can be molded, shaped and cut into different angles and shapes, creating different size and shaped artificial reefs. The preferred method for cutting the Expanded Polystyrene Geo Foam blocks is with a hot cutting wire. Another advantage of the current invention is that the Expanded Polystyrene Geo Foam speeds up the construction time of building a reef in a body of water. The previous method for building an artificial reef in a surf pool is to move and shape dirt into the desired bottom bathymetry. This method requires heavy machinery and tools, such as dirt spitters, excavators, shovels, racks, wheel barrows and lots of laborers to shape and place the dirt on the bottom to shape a reef. The process of removing, replacing, and shaping dirt into a reef shape is very time consuming and expensive. The current invention requires no machinery or tools and does not require a lot of laborers to construct the geo foam reef. The Expanded Polystyrene Geo Foam blocks, due to its light weight, can actually be picked up by one person and carried to the reef construction location.

As used herein, the term "surfing" is defined to include long boarding, short boarding, bodysurfing, board surfing, body boarding and any other recreational water activities which require similar waves.

An earth anchor, connected by a galvanized cable to a round anchor disc is used to maintain the Expanded Polystyrene Geo Foam Blocks at a desired location, such as at a beach or within a wave pool, a lake, or in any other desired body of water. As used herein, the term "anchor" is defined to include a bullet or arrowhead-shaped earth anchor device, with a cable attached to it, which is then linked to a round anchor disc. A round recessed indention is made in the top of each Expanded Polystyrene Geo Foam block. The round anchor disc is then placed into the round indention on the top of the Geo Foam block. The cable attaches to the bottom of the anchor disc and runs through the middle of the Geo Foam Block, down into the ground and attaches to the earth anchor. The earth anchor device is used to attempt to maintain the artificial reef at a desired location within a body of water.

According to the preferred embodiment of the present invention, a plurality of Expanded Polystyrene Geo Foam blocks are attached to one another so as to define a reef. Alternatively, the artificial reef may be defined by a single geo foam block. Modular construction of the artificial reef facilitates the definition of a variety of different configurations of artificial surf reef which may be utilized for a corresponding variety of different applications. For example, V-shaped, triangle shaped, A-shaped, upside down U-shaped, boomerang shaped or Y-shaped reefs are generally preferred for providing waves suitable for surfing upon. Various other configurations of artificial reefs may be desirable for creating different waves in the body of water. For purposes of the current invention our preferred artificial reef shape is a boomerang shaped artificial reef, which contains a wedge, focus point, ledge, pinnacle, ramp and a platform or one reef element or a combination thereof to break the waves in the body of water. However, the Expanded Polystyrene Geo Foam Artificial Reef can be made to be shaped to any configuration, size or shape.

The use of a plurality of Expanded Polystyrene Geo Foam Blocks to define an artificial reef according to the present invention allows the individual Expanded Polystyrene Geo Foam blocks to be more easily transported and positioned within the body of water, as desired. The transportation and positioning of individual Expanded Polystyrene Geo Foam blocks is much lighter and simpler than the transporting and positioning of an entire, preassembled artificial reef. Thus, the individual Expanded Polystyrene Geo Foam blocks may be attached to one another at the desired location within a body of water, so as to define an artificial reef having the desired boomerang-shaped configuration.

By configuring the individual Expanded Polystyrene Geo Foam blocks so as to define an artificial reef having a boomerang-shaped configuration waves may be enhanced so as to be more suitable for surfing. Thus, waves which extend generally parallel to the beach or which extend diagonally with respect thereto may be caused to break in a manner wherein the break generally follows a path which is substantially parallel to the beach, so as to provide for surfing along a desirably increased distance. Such changing of the shape, slope, or contour of the Expanded Polystyrene Geo Foam blocks will change how the wave will form and break over the Expanded Polystyrene Geo Foam block reef.

The Expanded Polystyrene Geo Foam blocks can be cut or shaped into different shapes, sizes and heights, so as to facilitate configuring of the artificial reef in a desired manner. This method permits modification of the artificial reef in a manner which facilitates enhanced control of the reef's ability to modify waves. Enabling individual control over the size, shape and height of each Expanded Polystyrene Geo Foam block, enhances control over how fast a wave peels. By providing such individual control over the Expanded Polystyrene Geo Foam blocks, the depth of the reef is created so as to provide parameters over the size of a wave which plunges over when the wave encounters the artificial reef.

Expanded Polystyrene Geo Foam blocks are attached together; then a lake liner will be placed over top of the Expanded Polystyrene Geo Foam blocks to form a waterproof seal.

The present invention, which is an artificial reef, provides for facilitating the enhancement of waves so that the waves are better-suited for bodysurfing, board surfing, and boogie boarding and other recreational activities.

The artificial reef is placed by finding the Still Water Line (SWL) in the body of water. The height, slope and contour of the artificial reef are then calculated. The extra depth needed in the bottom of the body of water is then adjusted for the height of the Expanded Polystyrene Geo Foam blocks to be placed on the bottom. The width of the reef is calculated by determining the size of the wave and its breaking depth. Most waves start to break in 1.3 times the wave height. Most waves finish breaking at 0.076 times their wave height. The length of the artificial reef will be calculated by how long of a ride desired, the width available in the body of water, and the size and power of the wave produced. A deep channel will need to run along the outside of the artificial reef to continue to allow the wave to peel along its orthogonal breaking path.

It is rare to find surfing waves peeling regularly and consistently. Peaks in wave crests from unorganized swells and wave focusing as well as from undulating bathymetry cause waves to break in sections. Waves breaking in sections create interesting and challenging surfing rides because surfers can perform different maneuvers on the various sections. However, the section must not be so long or fast that the surfer is trapped behind the wave pocket. A new section begins when there is a change in wave height (HB), peel angle (a), or breaking intensity (BI), and is said to have a section length of (SL).

Different kinds of surfing waves suit different kinds of surfers, and surfers prefer to ride waves that match or challenge their abilities. The range of wave heights, peel angles, breaking intensities, and section lengths that a surfer can successfully negotiate depends on skill level. Also, it is known that the higher the skill level, the greater the ability to negotiate difficult sections and link sections together for long surfing rides.

Surfing is a recreational activity, and performing maneuvers is the goal of most surfers. The types of maneuvers a surfer performs are dependent on his or her ability, the style of surfing, and type of wave. The first investigations into types of surfing maneuvers were undertaken by Scarfe (2002) and Scarfe et al. (2002). The terms used to describe these maneuvers were noted to change among different groups of surfers but serve as a guide for studies into surfing maneuvers.

The Definitions of the Surfing Maneuvers are:

Surfing the Wave Crest: This is the most basic of all maneuvers, apart from surfing in a straight line toward the shore. It involves pointing the surfboard in the direction of the advancing wave break point and riding the wave face ahead of the break point. The speed of the surfer is determined by the peel rate of the wave. As the peel rate increases and decreases, so will the speed of the surfer. The surfer has no ability to generate speed.

Bottom Turn: After dropping down the face of a wave, a surfer needs to turn at the bottom of the wave set-up for the next maneuver. Bottom turns can be made after take-off or on any section of the wave. A surfer can obtain speed and power by pushing off of the bottom of the wave and into its powerful face (the power pocket).

Top Turn: This maneuver allows the surfer to drop back into a wave, either vertically for a slowly peeling wave or laterally for a quickly peeling wave. The radius of the turn is not tight. The maneuver is smooth so that speed is generated rather than lost.

Speed Weaving: A surfer can actively generate speed by weaving up and down, effectively dropping into the wave over and over again. This allows surfers to make it through fast sections or generate enough speed to perform advanced maneuvers. Speed weaving is simply the linking of top and bottom turns, or pumping the surfboard to generate speed via the boards design (e.g., through fin arrays, channels, etc.).

Reo: A Reo is similar to a top turn but executed more aggressive. The radius of the turn is very tight, and the surfer travels vertically up the wave face before the turn. Speed is lost during the maneuver. Reo's are best performed on waves with steep faces, so that the surfer is pushed out of the move with speed, ready for the next maneuver.

Cutback: Cutbacks allow surfers to stay in the power pocket of a wave. They are often performed at the end of a fast wave section when peel angle increases. The move involves the surfer outrunning the wave, and then performing a large radius turn back toward the advancing wave face.

Round House: A round house is a maneuver with two parts. First, the surfer performs a cutback, so that he or she surfer is now traveling toward the advancing wave. In this maneuver, the surfer rides a left-hand wave like a righthand wave, and the opposite is true for a righthand wave. The second part involves performing a Reo on the advancing wave face. The surfer is then pushed along by the breaking wave, ready to perform another maneuver.

Floater: Often the most enjoyable and efficient maneuver that can be used to negotiate a fast section is a floater. It involves traveling (floating) over the top of a wave to make it to the front of the wave face. High speeds are required to perform floaters, because once the surfer is on the top of the whitewater, speed is quickly lost. Floaters are also frequently performed at the end of a surfing ride when the wave closes out.

Foam Bounce: This maneuver is a cross between a floater and a top turn. The surfer generates speed, and then approaches a wave section in a way resembling a floater. However, rather than surfing right on top of the wave as when performing a floater, the surfer turns back down the wave face as when performing a top turn, and the breaking wave accelerates the surfer.

Aerial: This is an advanced maneuver. To perform an aerial, a surfer requires a great deal of speed. This maneuver is best performed on a steep wave section with a light onshore wind to hold the board against the surfer's feet.

Barrel: In this maneuver, a surfer rides inside a plunging wave section. This is the most desired maneuver by surfers. It is an advanced maneuver that requires the surfer to precisely control the speed and position vertically on the wave face.

Tail Slide: A tail slide can be performed at the end of an aggressively executed Reo or Gouge. Extra force is put into the turn, so that the tail slides freely. In order to do this, the surfboard fins must release themselves from the water.

Reverse: In a reverse, the surfer rides the surfboard backward. This maneuver requires that the surfer be very balanced, because the surfboard naturally tends to face forward because of the fins. To turn the surfboard around, surfers either do a tail slide or a 180° Ollie. An Ollie is an advanced move taken from skateboarding where the board is popped into the air by the surfer.

Stall: A stall is done when a surfer releases the weight of the front foot to slow the surfboard down. It is performed for a very short time to allow the wave to catch up to the surfer. A common use of a stall is to slow the surfer down enough to get a barrel ride without outrunning the wave, after a top or bottom turn.

Gouge or Hard Stall: This maneuver is very similar to a stall, but it is executed more quickly and aggressively. The tail is buried or gouged into the wave face by putting the surfers entire weight on the tail and performing a small turn.

In the current invention the artificial reef sections have different sections that are created by changing the peel angle and the bottom slope gradient. By changing the various peel angles of each section from a range of 20-90 degrees, will change the type of wave, which will allow surfers to do different surfers maneuvers on each section. Sections of the artificial reef that contain low peel angles from 20-45 degrees, will create very fast waves, that will allow for very advanced and experienced maneuvers. Peel angles that range from 46-55 degrees will allow intermediate surfers to perform standard maneuvers. Peel angles from 56-70 degrees will allow beginners to advanced beginners to standard surfing maneuvers, such as riding laterally along the wave or pumping. Also, within the artificial reef sections will have different slope gradients ranging from 1-4 slope to a 1-25 slope along the wave breaking path. The lower slopes from 1-4 to 1-12 will produce plunging or barreling breaking waves within the sections with these slope ranges. The higher slope gradients from 1-13 to 1-25 will create more gentle spilling waves. More geared to beginner surfers. The lower the peel angle on the artificial reef the faster the wave will transverse along the breaking path of the reef.

DESCRIPTION OF THE DRAWINGS

These, and other features, aspects and advantages of the present invention will be more fully understood when considered with respect to the following detailed description, appended claims and accompanying drawings wherein:

DETAILED DESCRIPTION OF THE PREFERRED EMBODIMENT

The detailed description set forth below in connection with the appended drawings is intended as a description of the presently preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to be encompassed within the spirit and scope of the invention.

The artificial reef of the present invention is illustrated in FIGS. 1A, 1B, 2, 3 and 4 which depict presently preferred embodiments thereof.

Referring now to FIGS. 2, 3, 4, 5, the artificial reef of the present invention may optionally be configured to have a generally boomerang shape, so as to enhance the suitability of waves passing thereover for surfing and other recreational water activities. By orienting the artificial reef of FIG. 3 and FIG. 4 such that the reef elements and the reef sections of the artificial reef cause the wave to break in a manner which enhances their suitability for surfing.

When waves encounter the reduced water, depth defined by the artificial reef, then those waves tend to break or topple over. Because of its boomerang-shape, with a wedge running along the sides, the artificial reef causes waves to break in two different directions and in a manner wherein the break tends to run generally parallel to the beach. Thus, for waves which are generally parallel or diagonal to the beach, the artificial reef causes a break to form proximate the apex thereof and then to move generally parallel to the beach in a manner which enhances the wave's suitability for surfing by increasing the amount of time that the wave may be ridden. Also, the time at which the wave peels and the degree of peeling may be substantially controlled by the depth and placement of the artificial reef. In this manner, the face of the wave may be modified in a manner which enhances the wave suitability for surfing.

Thus, the boomerang-shaped artificial reef tends to form two separately breaking waves, each wave traveling in an opposite direction along the beach. These two waves may each be utilized for recreational activities such as bodysurfing, board surfing, and boogie boarding.

Figure 1A:
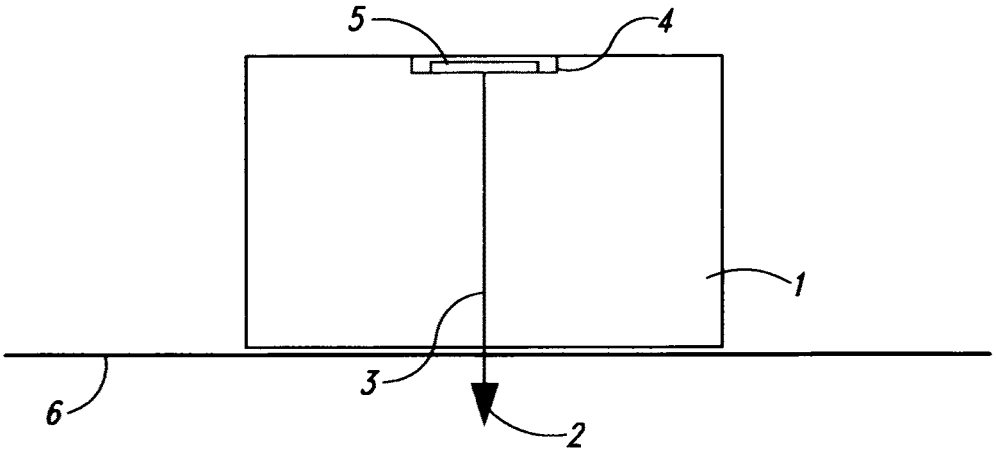
FIG. 1A is a view of the Expanded Polystyrene Geo Foam blocks anchored down to the bottom of the body of water.

FIG. 1A illustrates how the Geo Foam Blocks 1 are anchored to the bottom of the surf pool to form the bottom bathymetry which is optimal for surfing. At the top of each Geo Foam Block is a round recessed circle 4, placed in the round recessed area is a round plastic anchoring disc 5. The earth anchor 2 is driven into the ground 6. Attached to the earth anchor is a cable 3. When the cable is pulled tight through the disc 5, the block becomes secure to the ground 6.

Figure 1B:
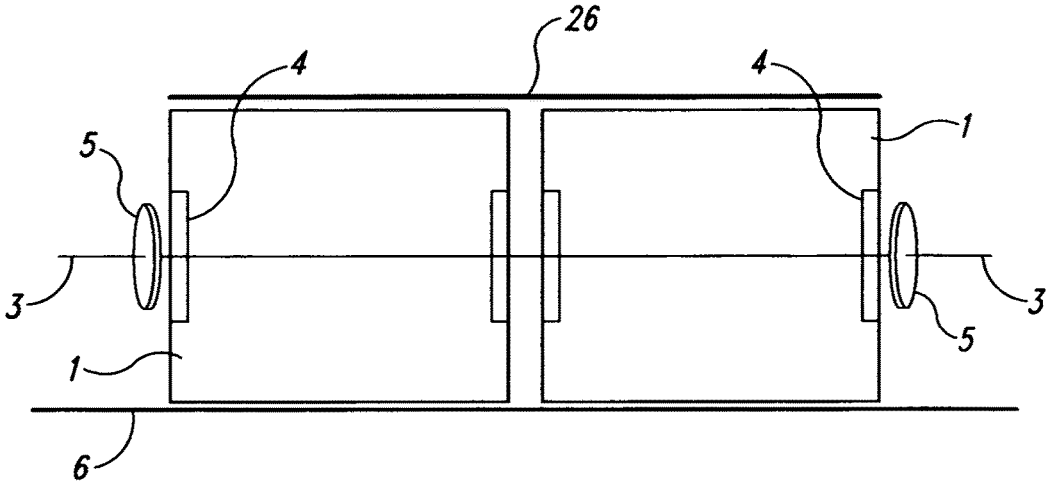
FIG. 1B is a view of the Expanded Polystyrene Geo Foam Blocks anchored to an adjoining block.

FIG. 1B illustrates how two Geo Foam Blocks 1 are anchored securely to each other. At the side of each Geo Foam Block is a round disc 5. The cable 3 is driven through both blocks. When the cable is pulled tight through the disc 5, the blocks 1 become secured to each other. Sprayed over top of the Geo Foam blocks is a gypsum plastic membrane 26 that holds the geo foam blocks together and creates a water proof membrane over top of the Artificial Geo Foam Reef.

Figure 2:
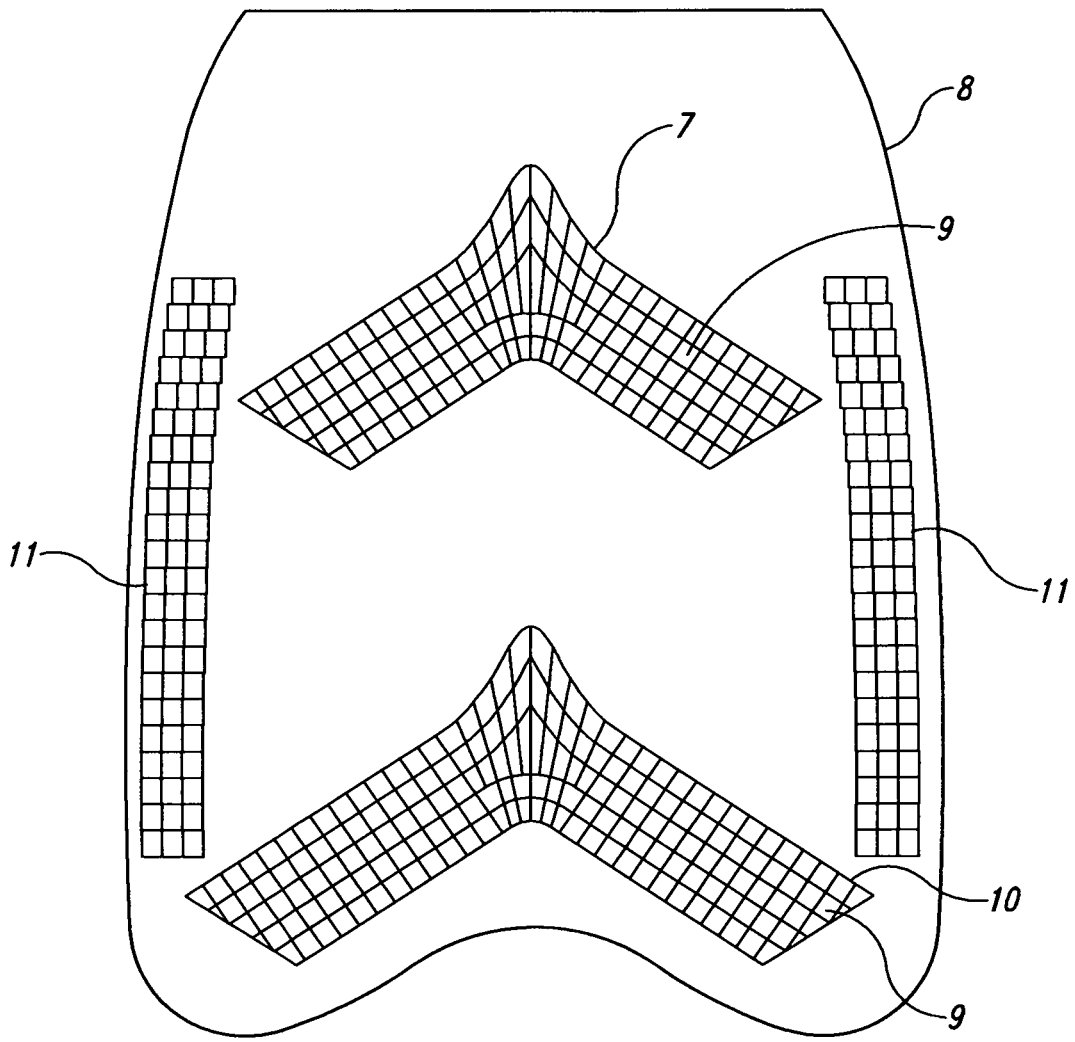
FIG. 2 is a perspective view of a surf pool comprising a premier artificial surf reef, secondary inner surf reef and side reefs, comprising a plurality of individual Expanded Polystyrene Geo Foam blocks to form the surf reefs in a body of water.

FIG. 2 illustrates Geo Foam Blocks 9 being placed in the surf pool 8 to create surfing reefs. The first surf reef is a premier surf reef 7. As the wave transverses the length of the surf pool, the wave then breaks over a second inner reef 10. While the wave is breaking over the premier and secondary reefs the waves are also breaking along a side surf reef 11.

Figure 3:
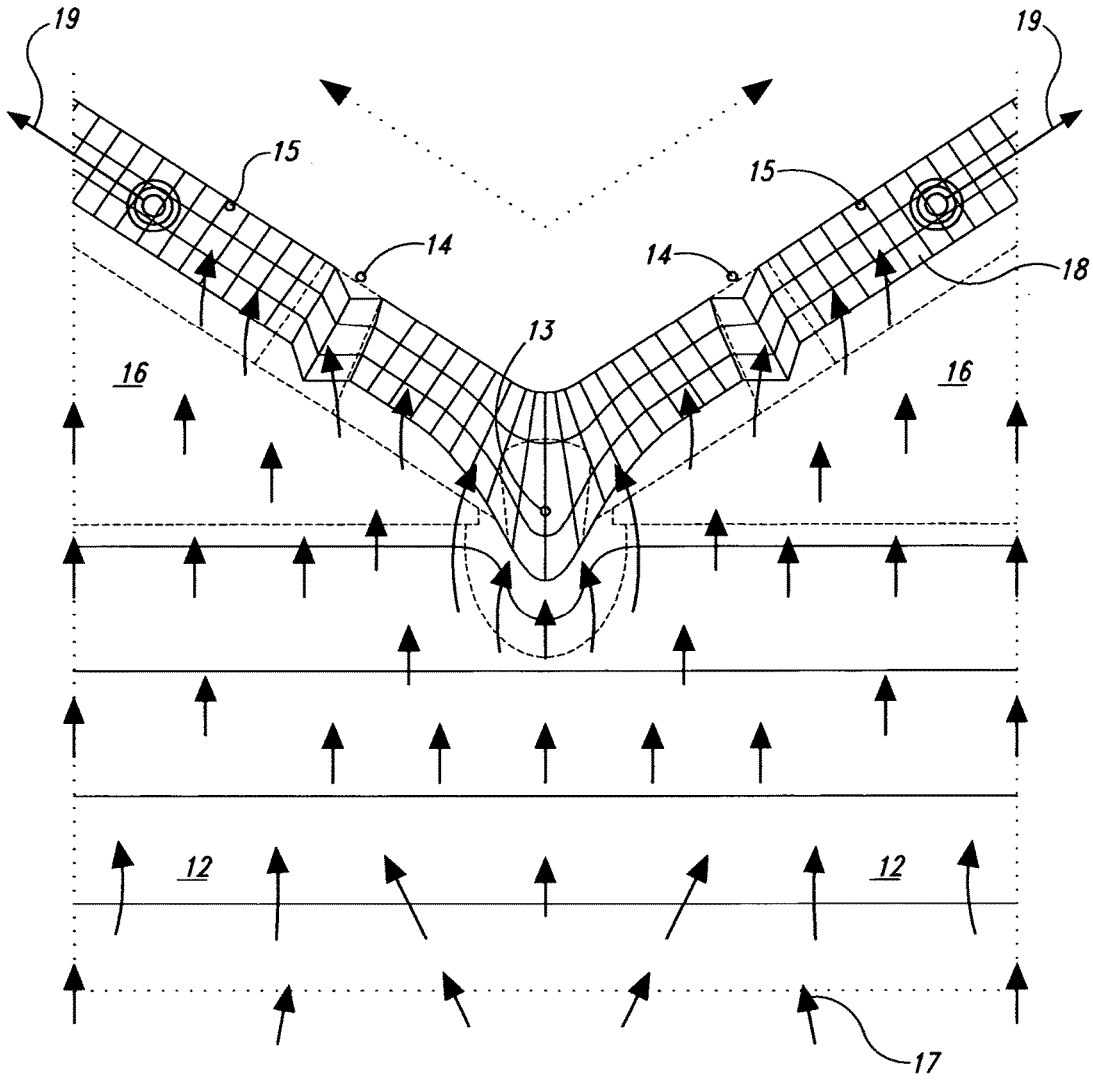
FIG. 3 is top view of the boomerang-shaped artificial surf reef comprising a plurality of Expanded Polystyrene Geo Foam Blocks.

FIG. 3. Illustrates a boomerang-shaped reef made of Geo Foam Blocks. The reef has different breaking elements to create different breaking waves. The waves come up a straight breaking direction to the reef 17. The first part of the reef structure is a ramp 12. The waves are refracted towards the favored orthogonal direction as they travel up a ramp. The waves then convergence as the wave travels up the focus 13 part of the reef. As the wave transverses down the side of the reef, it encounters a ridge, wedge and ledge. The waves are refracted away from the forward orthogonal direction prior to breaking on a wedge 18. The wedge is the main wave breaking component of most surf breaks. Very little refraction occurs as waves travel up the ledge part of the reef 15. The steeper seabed gradient and the deflection in isobath orientation results in a hollower and faster section in the wave as it travels up a ridge 14. Just before the wave breaks over the wedge, ridge and ledge part of the surf reef the wave encounters a platform 16, which is a flat horizontal plane and therefore has little effect on the advancing wave. The platform 16, joins different components of the reef without altering wave orientation or causing excessive shoaling. The last wave breaking component that the wave encounters toward the end of the surf reef is the pinnacle 19. The pinnacle increases breaker intensity in the same way as a ridge, except it does so more abruptly and affects a smaller area. Pinnacles often define the take-off zone and help surfers to catch waves, as do focuses.

Figure 4:
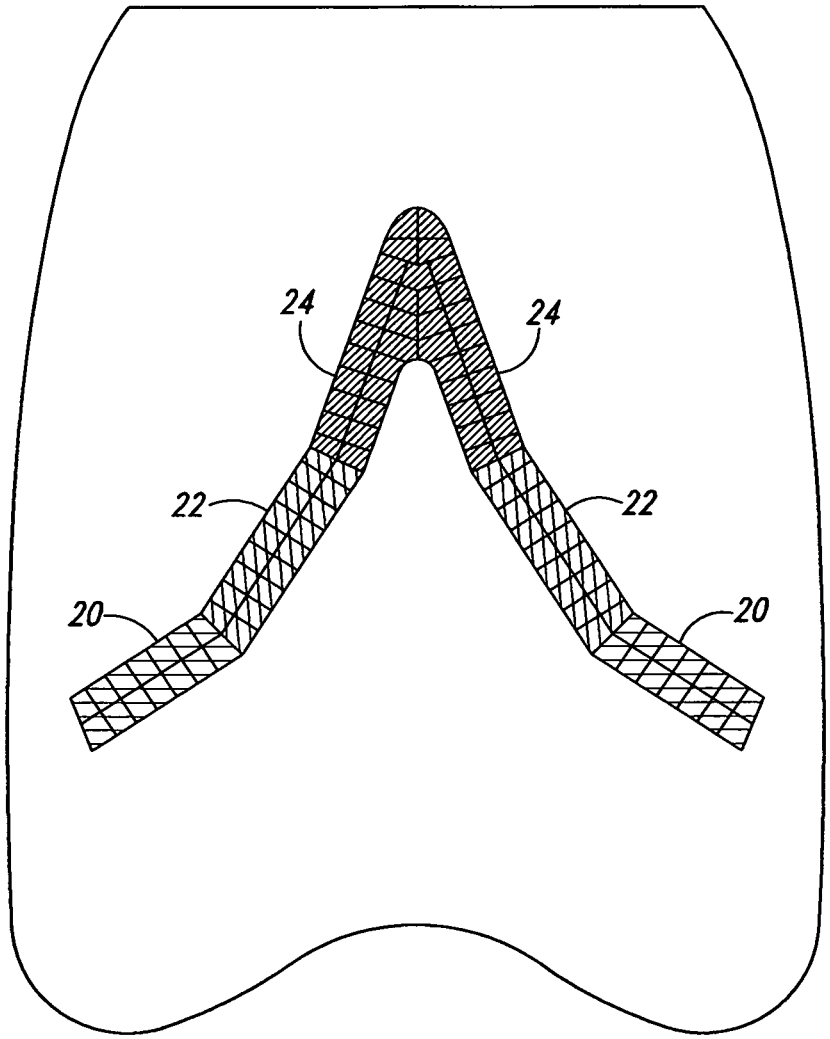
FIG. 4 is a top view of the different artificial reef maneuvering sections that illustrate different peels angels to allow surfers to perform different surfing maneuvers on the various sections.

FIG. 4. Illustrates an artificial reef made of geo foam blocks 1 that consist of different reefs sections, that consist of different peel angles. Each different section with the different peel angles creates a section that creates different kinds of maneuvers. In the current invention the artificial reef sections have different sections that are created by changing the peel angle. By changing the various peel angles of each section from a range of 20-90 degrees, will change the type of wave, which will allow surfers to do different surfers maneuvers on each section. Sections of the artificial reef that contain low peel angles from 20-45 degrees, will create very fast waves, that will allow for very advanced and experienced maneuvers. These sections will be focused to the more experienced or pro surfer. Peel angles that range from 46-55 degrees will allow intermediate surfers to perform standard maneuvers. Peel angles from 56-70 degrees will allow beginners to advanced beginners to standard surfing maneuvers such as riding laterally along the wave or pumping. Also within the artificial reef sections will have different slope gradients ranging from 1-4 slope to a 1-25 slope along the wave breaking path. The lower slopes from 1-4 to 1-12 will produce plunging barreling breaking waves within the sections with these slope ranges. The higher slope gradients from 1-13 to 1-25 will create more gentle spilling waves. More geared to beginner surfers. The lower the peel angle on the artificial reef the faster the wave will transverse along the breaking path of the reef. The first section of the artificial reef 24 has a very low peel angle between 25-45 degrees. This section will be geared and focused to more experienced surfers. In this section will allow more down the line tube riding or barrel riding. The second section of the artificial reef 22 has a peel angle from 46-55 degrees which allows for more intermediate standard surfing maneuvers. The third section of the artificial reef 20 has a peel angle from 56-70 degrees, which will create a slower wave for advanced beginners and beginners to start to learn very basic maneuvers. This third section of reef will create a more mellow spilling wave, which will be focused toward beginner surfers.

Figure 5:
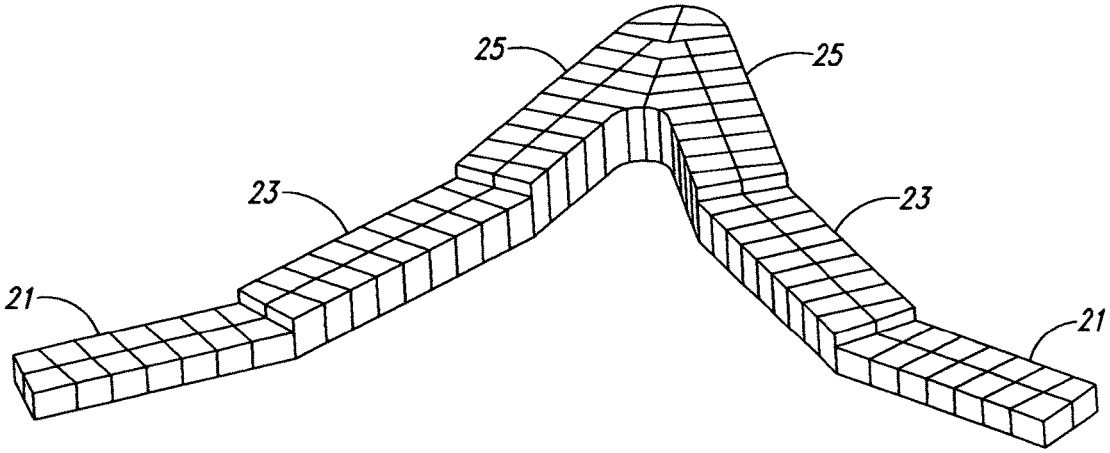
FIG. 5 is a top view of the different artificial reef maneuvering sections that illustrate different slope gradients to allow surfers to perform different surfing maneuvers on the various sections.

FIG. 5 Illustrates an artificial reef made of geo foam blocks, that consist of different reefs sections, that consist of different peel angles and different bottom gradient slopes. Each different section with the different slope gradients creates a section that creates different kinds of maneuvers. In the current invention the artificial reef sections have different sections that are created by changing the bottom slope gradient. By changing the various slope gradients 1-4 to 1-25 of each section, will change the type of wave, which will allow surfers to do different surfers maneuvers on each section. Also within the artificial reef sections will have different slope gradients ranging from 1-4 slope to a 1-25 slope along the wave breaking path. The lower slopes from 1-4 to 1-12 will produce plunging barreling breaking waves within the sections with these slope ranges. The higher slope gradients from 1-13 to 1-25 will create more gentle spilling waves. More geared to beginner surfers. The first reef section has a steeper sloped gradient 25 ranging from 1-4 to 1-12, which will create a more plunging or barreling wave. The second section of the artificial reef 23, this section will have a slope gradient of 1-7 to 1-11 range, which will create a lower vortex ratio and a skinner barrel formation. The slope gradient in this third section 21 will be between 1-13 to 1-25. This third section of reef will create a more mellow spilling wave, which will be focused toward beginner surfers.

The invention claimed is:

1. An artificial reef system comprising a plurality of artificial reefs, each one of the artificial reefs is made of a plurality of expanded polystyrene geo foam blocks, each one of the plurality of expanded polystyrene geo foam blocks is attachable to an earth anchor, each earth anchor is attached to a galvanized cable, each galvanized cable is attached to a round anchor disc, each round anchor disc is in a recess in the top of each expanded polystyrene geo foam block for maintaining the block at a desired location substantially under water, and wherein at least two expanded polystyrene geo foam blocks are configured to facilitate attachment to one another, and wherein the at least two expanded polystyrene geo foam blocks are attached to each other by applying a plasticized gypsum composition spray over the at least two expanded polystyrene geo foam blocks, and wherein the plasticized gypsum composition spray over the at least two expanded polystyrene geo foam blocks creates a water proof seal.

2. The artificial reef system as recited in claim 1, wherein at least one of the artificial reefs is configurable in a boomerang shaped configuration, said at least one of the artificial reefs configurable in a boomerang shape comprises a plurality of artificial reef sections, said artificial reef sections include a ramp reef section, a platform reef section, a ledge reef section, a focus point reef section, a wedge reef section, and a pinnacle reef section.

3. The artificial reef system as recited in claim 1, wherein at least one of the artificial reefs comprises a plurality of artificial reef sections, wherein the artificial reef sections include varying peel angle sections from 20-70 degrees, and wherein the varying peel angle sections modify a speed of a wave propagating along the artificial reef system to enhance suitability for recreational water activities.

4. The artificial reef system as recited in claim 1, wherein at least one of the artificial reefs comprises a plurality of artificial reef sections, wherein the artificial reef sections include varying bottom slope contours that range from 1:4 slope gradient to 1:25 slope gradient, wherein the varying bottom slope contours create at least one of a plunging wave and spilling wave.

5. The artificial reef system as recited in claim 1, wherein at least one of the artificial reefs comprises a plurality of artificial reef sections, wherein the artificial reef sections comprise at least one of a surfing maneuver section selected from the group consisting of a barrel surfing maneuver section, an aerial surfing maneuver section, a weaving surfing maneuver section, a cut back surfing maneuver section, and a reo surfing maneuver section.

* * * * *